US008075328B2

(12) United States Patent
Ashibu

(10) Patent No.: US 8,075,328 B2
(45) Date of Patent: Dec. 13, 2011

(54) CONNECTOR WITH AN ACTUATOR PUSHED BY A BASE-PLATE

(75) Inventor: Kenta Ashibu, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 12/932,863

(22) Filed: Mar. 8, 2011

(65) Prior Publication Data

US 2011/0244709 A1 Oct. 6, 2011

(30) Foreign Application Priority Data

Mar. 30, 2010 (JP) ..... 2010-079062

(51) Int. Cl.
*H01R 13/62* (2006.01)

(52) U.S. Cl. ..... 439/260

(58) Field of Classification Search ..... 439/260–264, 439/494–496, 630, 372
See application file for complete search history.

(56) References Cited

U.S. PATENT DOCUMENTS

| | | | | |
|---|---|---|---|---|
| 6,755,682 | B2 * | 6/2004 | Kunishi et al. | 439/495 |
| 7,275,954 | B2 * | 10/2007 | Ikenaga et al. | 439/494 |
| 7,311,542 | B2 * | 12/2007 | Suzuki | 439/260 |
| 7,344,399 | B2 * | 3/2008 | Iijima et al. | 439/260 |
| 7,494,366 | B2 * | 2/2009 | Suzuki et al. | 439/495 |
| 7,563,128 | B2 * | 7/2009 | Suzuki et al. | 439/495 |
| 7,828,571 | B2 * | 11/2010 | Satoh et al. | 439/260 |

FOREIGN PATENT DOCUMENTS

| | | |
|---|---|---|
| JP | 2004-039479 | 2/2004 |
| JP | 2006-351288 | 12/2006 |
| JP | 2009-205914 | 9/2009 |
| JP | 2010-225448 | 10/2010 |

OTHER PUBLICATIONS

English translation of relevant parts of Japanese Office Action dated Dec. 15, 2010.

* cited by examiner

*Primary Examiner* — Chandrika Prasad
(74) *Attorney, Agent, or Firm* — Collard & Roe, P.C.

(57) ABSTRACT

A connector 100 for use in accepting a base-plate, the connector 100 comprising; a housing 110; an actuator unit 120 which is rotatably attached to the housing 110; and a contact 130 which has a first clipping portion 131*a* and a second clipping portion 132*a*, wherein the actuator unit 120 has; a rotary axis 123 which is located in a direction transverse to an inserting direction X of the base-plate T1; an action point portion 122 which is rotatable around the rotary axis 123; and an operating point portion 124 which is rotatable around the rotary axis 123, wherein at least one of the first clipping portion 131*a* and the second clipping portion 132*a* functions as the contact point between the contact 130 and the base-plate T1, wherein the operating point portion 124 is located on a back side X2 of the clipping portions 131*a*, 132*a* in the inserting direction X of the base-plate T1.

7 Claims, 10 Drawing Sheets

CONNECTOR WITH AN ACTUATOR PUSHED BY A BASE-PLATE

This application is based upon and claims the benefit of priority from Japanese patent application No. 2010-079062, filed on Mar. 30, 2010, the disclosure of which is incorporated herein in its entirety by reference.

TECHNICAL FIELD

This invention relates to a connector, especially, a connector which connects a flat connection object, such as a FPC (Flexible Printed Circuit) or a FFC (Flexible Flat Cable), and other connection object.

BACKGROUND ART

A connector of this type is disclosed, for example, in Japanese Patent Publication No. JP 2006-351288 A entitled "Connector" and referred to as Patent Document 1. Referring to FIG. 14, the connector disclosed in JP 2006-351288 A comprises a housing 510 and a number of contacts 530 supported by the housing 510. The contact 530 has a number of pairs of contact portions 531*a*, 532*a* and comprises a first contact portion 531*a* and a second contact portion 532*a* respectively. The first contact portion 531*a* and the second contact portion 532*a* are faced each other in the state which the first contact portion 531*a* and the second contact portion 532*a* are not contacted with each other. The first contact portion 531*a* and the second contact portion 532*a* are displaced or separated by a connection object T1 which is inserted between the first contact portion 531*a* and the second contact portion 532*a*. In this event, the first contact portion 531*a* and the second contact portion 532*a* are resiliently contacted to the connection object T1. To this end, the first contact portion 531*a* and the second contact portion 532*a* have opposed surfaces formed in concavo-convex shape respectively.

In the connector 500 disclosed in Patent Document 1 and shown in FIG. 14, surfaces of the connection object T1 is scraped by the first contact portion 531*a* and the second contact portion 532*a* due to an edge of the connection object T1 acting as a cutting edge, when the connection object (flexible base-plate) T1 is thick within a tolerance. Therefore, there is a possibility that pads of the connection object T1 might be removed.

Also, it is difficult to insert the connection object T1 between the first contact portion 531*a* and the second contact portion 532*a* if the connection object T1 becomes thick.

A connector device 600 is disclosed in Japanese Patent Publication No. JP 2004-39479 A (Patent Document 2) entitled "Connector device for flexible printed wiring board" and is shown in FIGS. 15 and 16. The connector device can solve problems about damages resulting from the connection object T1 and about difficulty of inserting the connection object T1 between the first contact portion and the second contact portion of the contact, as mentioned above in connection with Patent Document 1.

As illustrated in FIGS. 15 and 16, this connector 600 comprises a housing 610, an actuator unit 620, and a number of contacts 630. The contacts 630 have each an upper contact portion 631*a* and a lower contact portion 632*a* facing to the upper contact portion 631*a*, with a clearance or a gap left between the upper and the lower contact portions 631*a* and 632*a*. The contacts 630 are arranged in parallel with one another in the housing 610. The clearance between the upper contact portion 631*a* and the lower contact portion 632*a* is wider than a thickness of flexible printed wiring board T1 before the actuator unit 620 is operated. The actuator unit 620 is operated by hand to narrow the clearance between the upper contact portion 631*a* and the lower contact portion 632*a*. When the flexible printed wiring board T1 is attached to the connector 600 and is thereafter inserted to the connector 600, the actuator unit 620 is hand to clip the flexible printed wiring board T1 by the upper contact portion 631*a* and the lower contact portion 632*a* with a predetermined pressure.

SUMMARY OF THE INVENTION

However, the connector 600 disclosed in Patent Document 2 requires two operations about attaching or clipping the flexible printed wiring board T1. That is to say, two operations consist of an operation inserting the flexible printed wiring board T1 and an operation of manipulating the actuator unit 620. Therefore, such two operations are troublesome and impose a heavy work burden on attaching the flexible printed wiring board T1 to the connector 600.

In addition, it might happen that an excessive force is imposed on each component, such as the actuator unit 620 and brings about a damage of the actuator unit because the actuator unit 620 is operated by hand.

Moreover, it is difficult to operate the actuator unit 620 by hand with the ordinary operator's fingers if the case of the connector 600 becomes very small in size. In the case, a work to attach the flexible printed wiring board T1 to the connector 600 becomes increasingly difficult.

It is therefore an exemplary object of this invention to provide a connector which is for use in accepting a base-plate, namely, a flat connection object, and which makes it possible to accept the base-plate with only one operation, which is capable of preventing the base-plate from being damaged during inserting the base-plate, and which is capable of preventing an actuator unit or the like from being damaged.

According to an exemplary aspect of the present invention, there is provided a connector for use in accepting a base-plate, the connector comprising; a housing; an actuator unit which is rotatably attached to the housing; and a contact which has a first clipping portion and a second clipping portion, wherein the actuator unit has; a rotary axis which is located in a direction transverse to an inserting direction of the base-plate; an action point portion which is rotatable around the rotary axis; and an operating point portion which is rotatable around the rotary axis, wherein at least one of the first clipping portion and the second clipping portion functions as the contact point between the contact and the base-plate, wherein the operating point portion is located on a back side of the clipping portions in the inserting direction of the base-plate.

BRIEF DESCRIPTION OF THE DRAWINGS

The above features and advantages of the present invention will be more apparent from the following description of exemplary embodiments taken in conjunction with the accompanying drawings, in which.

DESCRIPTION OF THE EMBODIMENTS

Referring to Figures, description will be given of a connector 100 according to a first embodiment of this invention.

Figure 2:
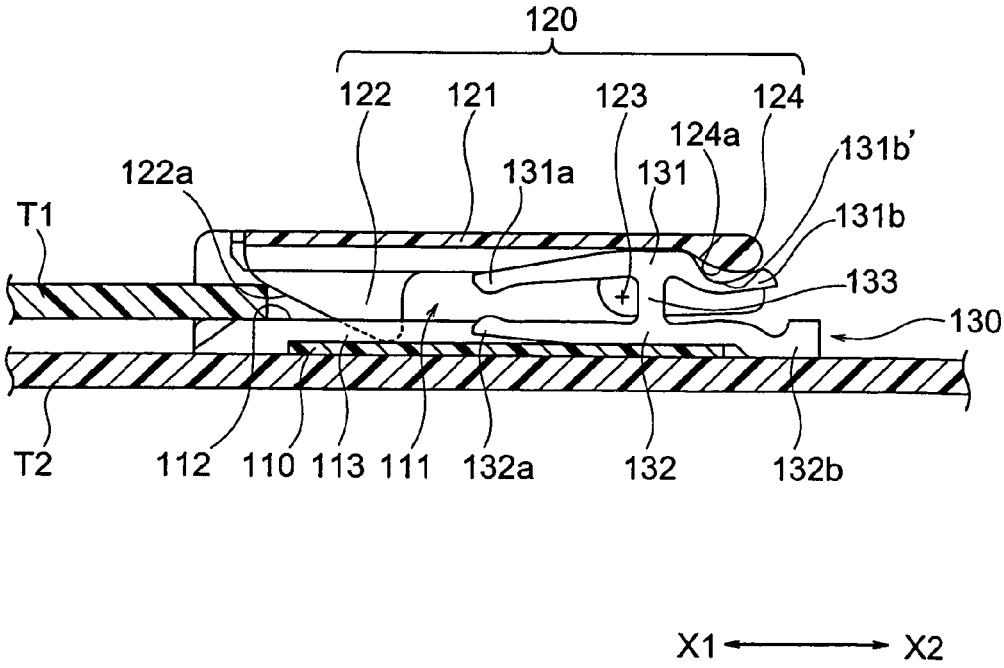
FIG. 2 is a sectional view of the connector illustrated in FIG. 1.

As shown in FIG. 2, the connector 100 according to the first embodiment of the present invention is used for connecting a first base-plate (FPC, Flexible Printed Circuit) T1 as a fist connection object and a second base-plate (printed base-plate) T2 as a second connection object.

Figure 1:
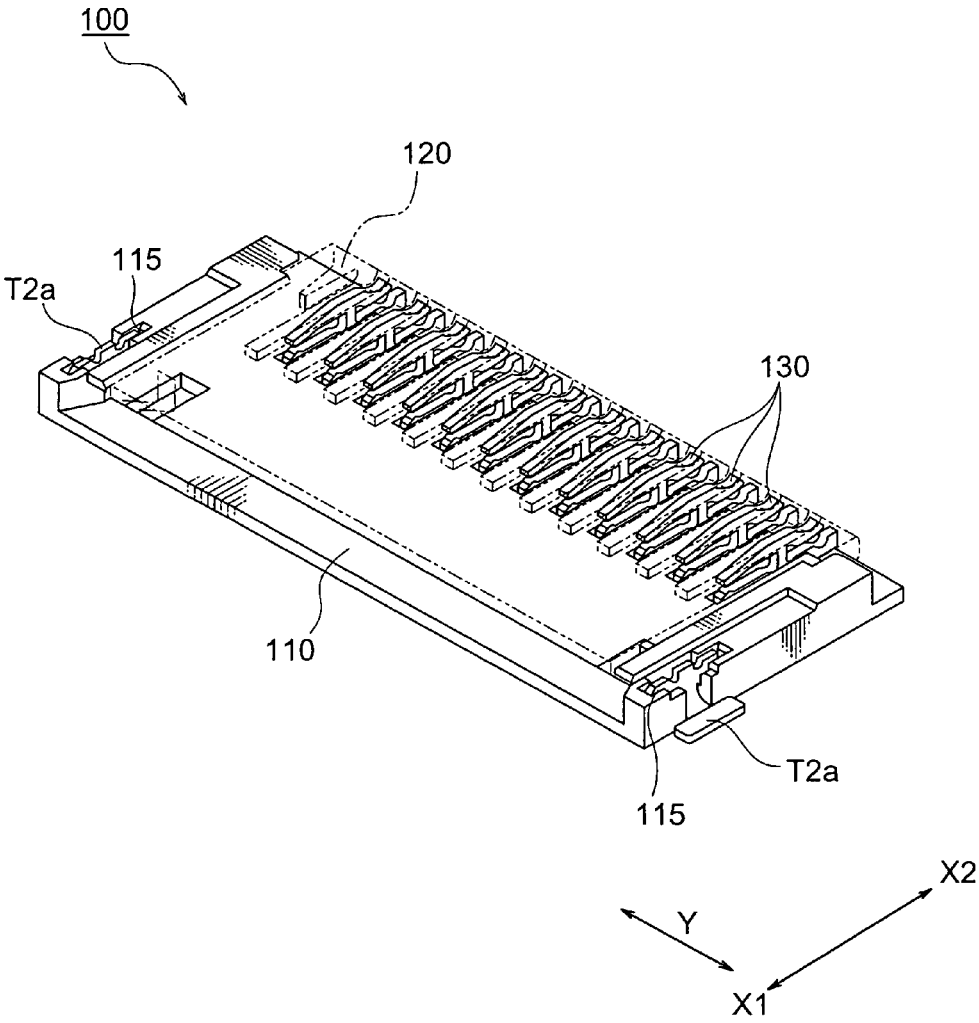
FIG. 1 is a perspective view of a connector according to a first embodiment of the present invention.

In FIGS. 1 and 2, the connector 100 comprises a housing 110 which has a receiving space 111 for use in receiving the first base-plate T1, an actuator unit 120 which is pivotally mounted to the housing 110, and a number of contacts 130 which is located within the housing 110. The housing 110 and the actuator unit 120 are made of insulating resin and the contact 130 is made of conductive materials, such as phosphor bronze.

Figure 3:
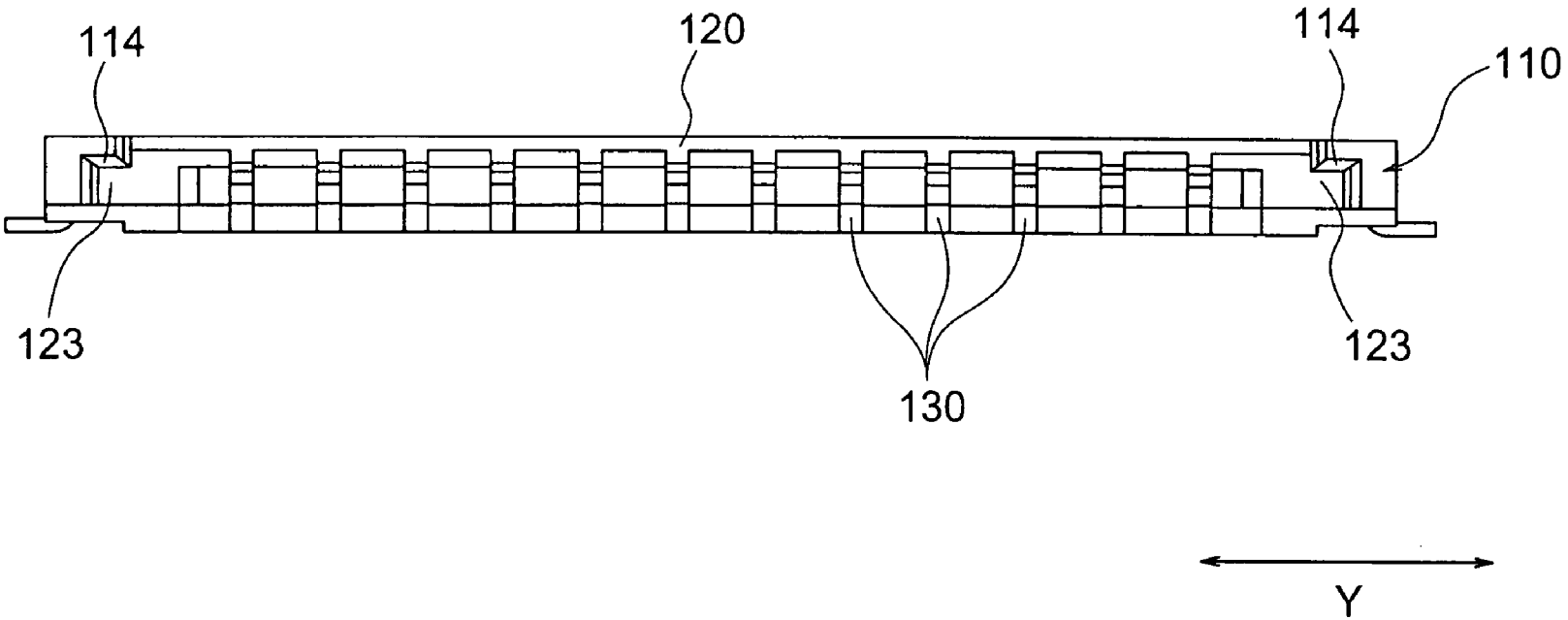
FIG. 3 is a rear view of the connector which is shown in FIG. 1 and which is viewed from back of the inserting direction of the base-plate.

Referring to FIGS. 1 to 3, the housing 110 comprises the receiving space 111 for use in receiving the first base-plate T1, a base-plate installation face 112 which faces to the actuator unit 120, a pair of depressed action point receiving portions 113 which are formed on the base-plate installation face 112 for use in receiving action point portions 122 of the actuator unit 120, a pair of bearing portions 114 which are formed on both side walls of a contact-width direction Y of the housing 110 for use in rotatably bearing a rotary axis 123 of the actuator unit 120 respectively, and a pair of hold-down holding portions 115 which are formed on side walls of housing 110 in the contact-width direction Y for use in holding hold-downs T2*a* of the second base-plate T2.

Figure 4:
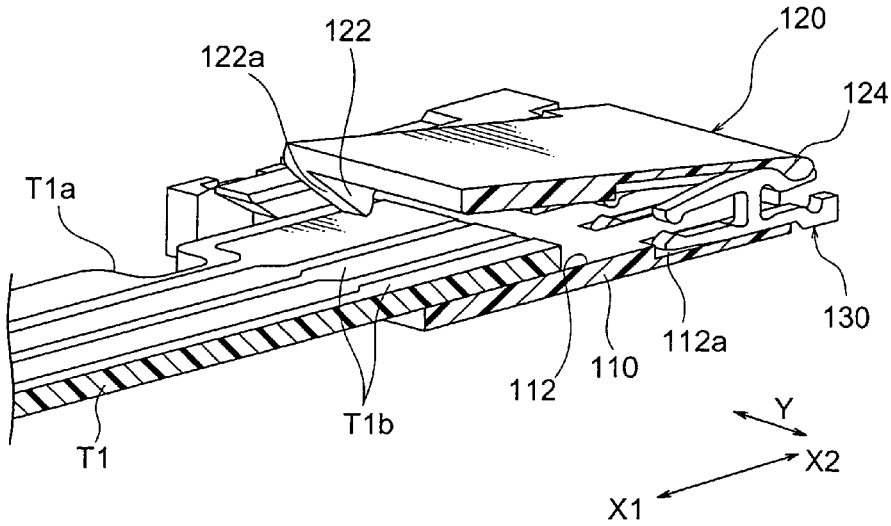
FIG. 4 is a sectional perspective view of the connector during attaching the first base-plate to the connector.

Referring to FIG. 4, the base-plate installation face 112 has a number of contact holding recesses 112*a* for use in holding the contacts 130 in parallel at a predefined pitch distance in the contact-width direction Y.

Referring to FIGS. 1 to 3, the actuator unit 120 comprises a body portion 121 which is rotatably attached to the housing 110, the pair of action point portions 122 which are formed on both side walls of the contact-width direction Y of the body portion 121 on a front side X1 of the inserting direction X of the first base-plate T1 and which is pushed up by the first base-plate T1 such that the action point portions 122 moves away from the base-plate installation face 112 when the first base-plate T1 is inserted to the connector 100, the rotary axis 123 which is formed on both side walls of the contact-width direction Y of the body portion 121 on a back side X2 of the action point portion 122 in the inserting direction X, and an operating point portion 124 which is formed on the body portion 121 in the back side X2 of the rotary axis 123 in the inserting direction X and which pushes down an operated or movable portion 131*b* of the contact 130 toward the base-plate installation face 112 when the first base-plate T1 is inserted to the connector 100. The rotary axis 123 is located in a direction transverse to the inserting direction X.

Referring to FIG. 2, a first distance between the action point portion 122 and the rotary axis 123 is longer than a second distance between the operating point portion 124 and the rotary axis 123. A center of gravity of the actuator unit 120 is located on the front side X1 of the rotary axis 123 in the inserting direction X. In FIG. 2, the action point portion 122 is projected from the body portion 121 toward the base-plate installation face 112. The illustrated action point portion 122 is located on the front side X1 of a first clipping portion (contact point) 131*a* and a second clipping portion 132*a* of the contact 130 in the inserting direction X. Furthermore, the action point portion 122 has a butting inclined surface 122*a* on its front side X1 in the inserting direction X. The butting inclined surface 122*a* is inclined such that the action point portion 122 comes near toward the base-plate installation face 112 to the back side X2 of the inserting direction X. Referring to FIG. 2, the operating point portion 124 is projected from the body portion 121 toward the base-plate installation face 112. In FIG. 2, the operating point portion 124 has a convex curved surface 124*a* which touches the operated portion 131*b* of the contact 130 when the actuator unit 120 is rotated. In FIG. 2, the operating point portion 124 is located on the back side X2 of the clipping portions 131*a*, 132*a* in the inserting direction X.

As shown in FIG. 2, the contact 130 has an I-shaped cross-section or an H-shaped cross-section rotated by 90 degrees. Specifically, the contact 130 comprises a first beam portion 131 which is located near the actuator unit 120, a second beam portion 132 which is located near the base-plate installation face 112, and a coupling portion 133 which is located between the first beam portion 131 and the second beam portion 132 and which couples a center part of the first beam portion 131 and a center part of the second beam portion 132. The first beam portion 131, the second beam portion 132 and the coupling portion 133 can be manufactured in an integrally-molding method.

Further referring to FIG. 2, the first beam portion 131 comprises the first clipping portion 131*a* which is located on the front side X1 of the coupling portion 133 in the inserting direction X, and the operated portion 131*b* which is located on the back side X2 of the coupling portion 133 in the inserting direction X. The first clipping portion 131*a* works as a contact point between a pad T1*b* of the first base-plate T1 and the contact 130. The operated or movable portion 131*b* has a concave curved surface 131*b*' facing to the curved surface 124*a* of the actuator unit 120.

On the other hand, the illustrated second beam portion 132 has the second clipping portion 132*a* which is located on the front side X1 of the coupling portion 133 in the inserting direction X, and the terminal portion 132*b* which is located on the back side X2 of the inserting direction X and which is solder-mounted to the second base-plate T2. Specifically, as shown in FIG. 4, the second beam portion 132 is held by the contact holding recess 112*a* of the housing 110 and is fastened to the housing 110. The first clipping portion 131*a* faces to the second clipping portion 132*a*. As readily understood from FIG. 2, the contact 130 is designed as normal-close type. That is to say, a clearance or a gap between the first clipping portion 131*a* and the second clipping portion 132*a* is narrower than a thickness of the first base-plate T1 before the first base-plate T1 is inserted into the connector 100.

Further referring to FIG. 4, the first base-plate T1 has a pair of action point receiving portions T1*a* which is formed by partially cutting out both sides of the first base-plate T1 for use in receiving the action point portion 122 of the actuator unit 120, and the pad T1*b* which is connected to the first clipping portion 131*a* of the contact 130.

Turning back to FIG. 1, the connector 100 can be mounted by solder through the hold-downs T2*a* of the connector 100 to the second base-plate T2 acting as the second connection object (not shown in FIG. 1). At any rate, the housing 110 shown in FIG. 1 and the second base-plate T2 are fastened each other by attaching the hold-downs T2*a* to the hold-down holding portion 115.

Referring to FIGS. 4 to 7, description will be made about a method of attaching the first base-plate T1 to the connector 100 and about a movement of each element of the connector 100 during attaching the first base-plate T1 to the connector 100.

Figure 5:
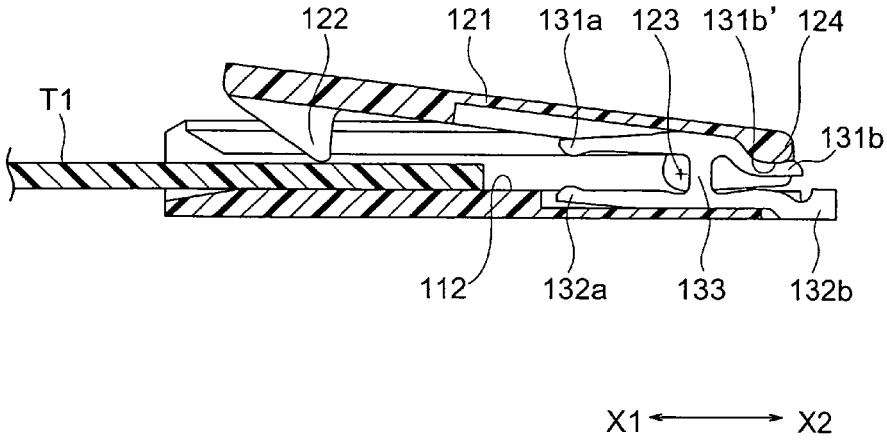
FIG. 5 is a sectional view of the connector during attaching the first base-plate to the connector.

In FIGS. 4 and 5, at first, the first base-plate T1 is inserted between the housing 110 and the actuator unit 120 from the front side X1 of the inserting direction X toward the back side X2 of the inserting direction X by an operator.

As sown in FIGS. 4 and 5, the action point portion 122 of the actuator unit 120 has the butting inclined surface 122*a* which is inclined such that the action point portion 122 comes near toward the base-plate installation face 112 to the back side X2 of the inserting direction X. Therefore, the action point portion 122 of the actuator unit 120 is pushed up by the first base-plate T1 so that the action point portion 122 moves away from the base-plate installation face 112.

Then, the actuator unit 120 rotates around the rotary axis 123 and the operating point portion 124 of the actuator unit 120 pushes down the operated portion 131*b* of the contact 130 toward the base-plate installation face 112. In FIGS. 4 and 5, it is to be noted that the first distance between the action point portion 122 and the rotary axis 123 is longer than the second distance between the operating point portion 124 and the rotary axis 123. Therefore, it is possible to easily push down the operating point portion 124 according to the principle of leverage and, therefore, to insert the first base-plate T1 to the connector 100 with small insertion power.

During the insertion operation, the operated portion 131*b* of the contact 130 is pushed down and the coupling portion 133 of the contact 130 is elastically-deformed, and the first clipping portion 131*a* is raised up so that the first clipping portion 131*a* moves away from the base-plate installation face 112. Thus, the clearance between the first clipping portion 131*a* and the second clipping portion 132*a* broadens. At this time, the clearance between the first clipping portion 131*a* and the second clipping portion 132*a* is broader than the thickness of the first base-plate T1.

Then, the first base-plate T1 is moved to the back side X2 of the inserting direction X by the operator and the first base-plate T1 is inserted between the first clipping portion 131*a* and the second clipping portion 132*a*.

Figure 6:
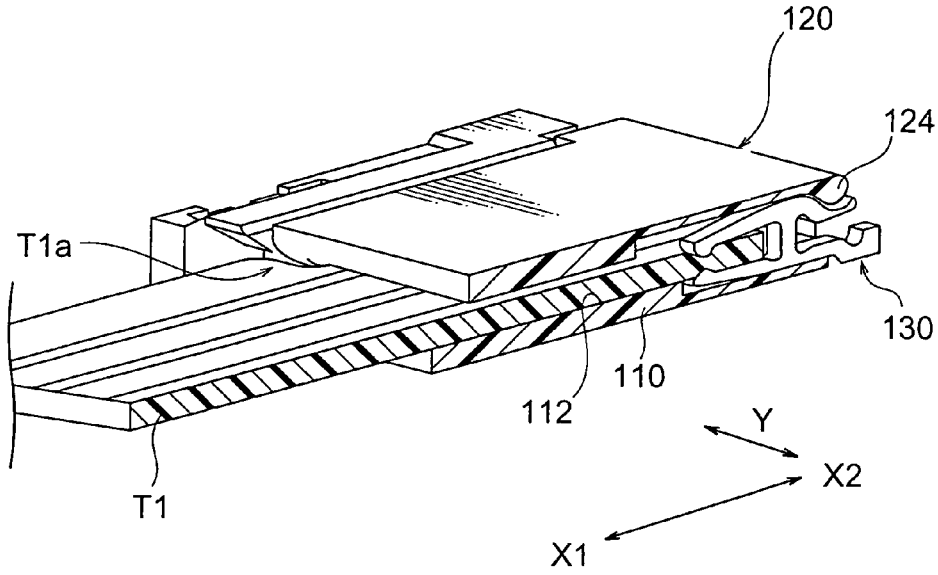
FIG. 6 is a sectional perspective view of the connector after attaching the first base-plate to the connector.
Figure 7:
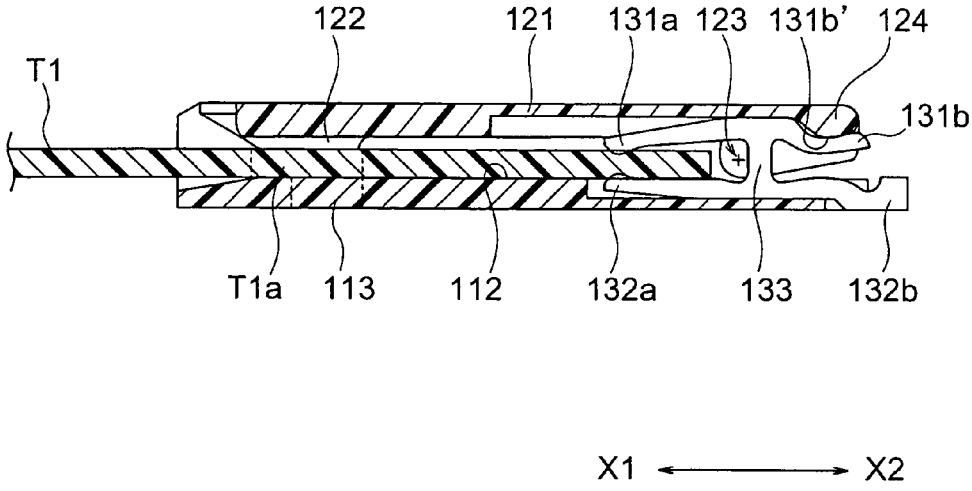
FIG. 7 is a sectional view of the connector after attaching the first base-plate to the connector.

As shown in FIGS. 6 and 7, the first base-plate T1 is further moved to the back side X2 of the inserting direction X by the operator, and the action point receiving portion T1*a* of the first base-plate T1 is aligned with a position of the action point portion 122 of the actuator unit 120.

At this time, the action point portion 122 of the actuator unit 120 is separated from and is not supported by the first base-plate T1, the coupling portion 133 returns to the original shape, and the actuator unit 120 rotates so that the action point portion 122 of the actuator unit 120 comes near the base-plate installation face 112.

As a result, as illustrated in FIGS. 6 and 7, the operated portion 131*b* is remote from the operating point portion 124 of the actuator unit 120, and the first clipping portion 131*a* and the second clipping portion 132*a* of the contact 130 tries to narrow the clearance to the original size, that is to say, tries to become narrower than the thickness of the first base-plate T1. Then the first clipping portion 131*a* and the second clipping portion 132*a* clip the first base-plate T1, thus the first clipping portion 131*a* and the pad T1*b* of the first base-plate T1 are connected to each other.

At the same time, the action point portion 122 of the actuator unit 120 is received by the action point receiving portion T1*a* of the first base-plate T1 and the action point receiving portion 113 of the housing 110. In the result, the first base-plate T1 is positioned to the connector 100, and the first base-plate T1 is prevented from falling off from the connector 100.

Referring to FIGS. 4 to 7, description will be given of a method of detaching the first base-plate T1 from the connector 100.

At first, a tool having a sphenoid head part is inserted between the butting inclined surface 122*a* of the action point portion 122 and the first base-plate T1 by the operator. The tool is not shown in the figures.

As a result, the action point portion 122 of the actuator unit 120 is pushed up so that the action point portion 122 moves away from the base-plate installation face 112, thus the actuator unit 120 rotates around the rotary axis 123.

Then the operating point portion 124 of the actuator unit 120 pushes down the operated portion 131*b* of the contact 130 toward the base-plate installation face 112.

Then, the coupling portion 133 is elastically deformed and the first clipping portion 131*a* moves away from the base-plate installation face 112, thus the clearance of the first clipping portion 131*a* and the second clipping portion 132*a* broadens.

Thus, it is possible to easily pull out the first base-plate T1 from between the first clipping portion 131*a* and the second clipping portion 132*a* by the operator.

In the case of this embodiment of the connector 100, the actuator unit 120 is pivoted or rotated by inserting the first base-plate T1, and by elastically deforming the contact 130 due to rotation of the actuator unit 120. As a result, the clearance between the first clipping portion 131*a* and the second clipping portion 132*a* of the contact 130 is broadened. Therefore, a manual operation of rotating the actuator unit 120 is not needed in addition to an operation inserting the first base-plate T1. This shows that the first base-plate T1 can be inserted by carrying out only one operation inserting the first base-plate T1 and a work burden can be reduced to insert the first base-plate T1.

In the case of the illustrated connector 100, the actuator unit 120 is rotated by inserting the first base-plate T1 without manually rotating the actuator unit 120 with by hand. Therefore, amount of rotation of the actuator unit 120 is restricted to a requisite amount which is needed to enable to insert the first base-plate T1 between the first clipping portion 131*a* and the second clipping portion 132*a*. Thus, it is possible to prevent the actuator unit 120 from receiving an excessive force as in the case the actuator unit 120 is operated by hand and thus it is possible to prevent the actuator unit 120 or the like from being damaged.

Inserting the first base-plate T1 automatically broadens a requisite amount of the clearance between the first clipping portion 131*a* and the second clipping portion 132*a*. Therefore, even if the thickness of the first base-plate T1 is thick within tolerance, it is possible to prevent the first base-plate T1 from sliding with a large friction on the first clipping portion 131 and the second clipping portion 132*a*, thus it is possible to prevent the first base-plate T1 from being damaged.

As previously explained, operating the actuator unit 120 by hand is not needed. Therefore, even if the connector 100 is very small in size, it is possible to avoid a situation which it is difficult to operate the actuator unit by hand with the ordinary operator's fingers as the prior art, thus it is possible to easily achieve attaching the first base-plate T1.

The housing 110 and the first base-plate T1 have the action point receiving portion 113 and a recessed portion T1*a* for use in receiving the action point portion 122 of the actuator unit 120, respectively. Therefore, it is possible to reduce a thickness of the connector 100, to position the first base-plate T1 to the connector 100, and to prevent the first base-plate T1 from being separated from the connector 100. Thus, it is possible to maintain certainty of the electronic connection between the pad T1*b* of the first base-plate T1 and the first clipping portion 131*a* of the contact 130.

The first distance between the action point portion 122 and the rotary axis 123 is longer than the second distance between the operating point portion 124 and the rotary axis 123. Therefore, it is possible to easily push down the operating point portion 124 according to the principle of leverage even if the first base-plate T1 is inserted to the connector 100 with small force, thus it is possible to avoid an excessive physical contact between the first base-plate T1 and the action point portion 122 of the actuator unit 120 during inserting the first base-plate T1, it is possible to prevent the first base-plate T1 to being damaged, and it is possible to smoothly achieve inserting the first base-plate T1.

The action point portion 122 has a butting inclined surface 122*a* on its front side X1 of the inserting direction X and the butting inclined surface 122*a* is inclined such that the action point portion 122 comes near toward the base-plate installation face 112 to the back side X2 of the inserting direction X. Therefore, it is possible to easily push up the action point portion 122 even if the first base-plate T1 is inserted to the connector 100 with small force, thus it is possible to avoid an excessive physical contact between the first base-plate T1 and the action point portion 122, and it is possible to smoothly achieve inserting the first base-plate T1.

The operating point portion 124 of the actuator unit 120 has the curved surface 124*a* and the operated portion 131*b* has the curved surface 131*b*'. Therefore, the curved surface 124*a* of the operating point portion 124 smoothly contacts to the curved surface 131*b*' of the operated portion 131*b* when the operating point portion 124 pushes down the operated portion 131*b*, thus it is possible to smoothly achieve inserting the first base-plate T1.

A center of gravity of body portion 121 is located on the front side X1 of the rotary axis 123 in the inserting direction X. Therefore, it is possible to prevent the actuator unit 120 from floating from the housing 110 before or after attaching the first base-plate T1 to the connector 100.

The operating point portion 124 is located on the back side X2 of the first clipping portion (the contact point) 131*a* in the inserting direction X. Therefore, it is possible to make the first base-plate T1 reach to the first clipping portion (the contact point) 131*a* without passing through the operating point portion 124 during attaching the first base-plate T1 to the connector 100. Thus it is possible to prevent the first clipping portion (the contact point) 131*a* and the first base-plate T1 from becoming contaminated from an abrasion powder which arises between the operating point portion 124 and the operated portion 131*b* due to a slide between the operating point portion 124 and the operated portion 131*b* of the contact 130.

Figure 8:
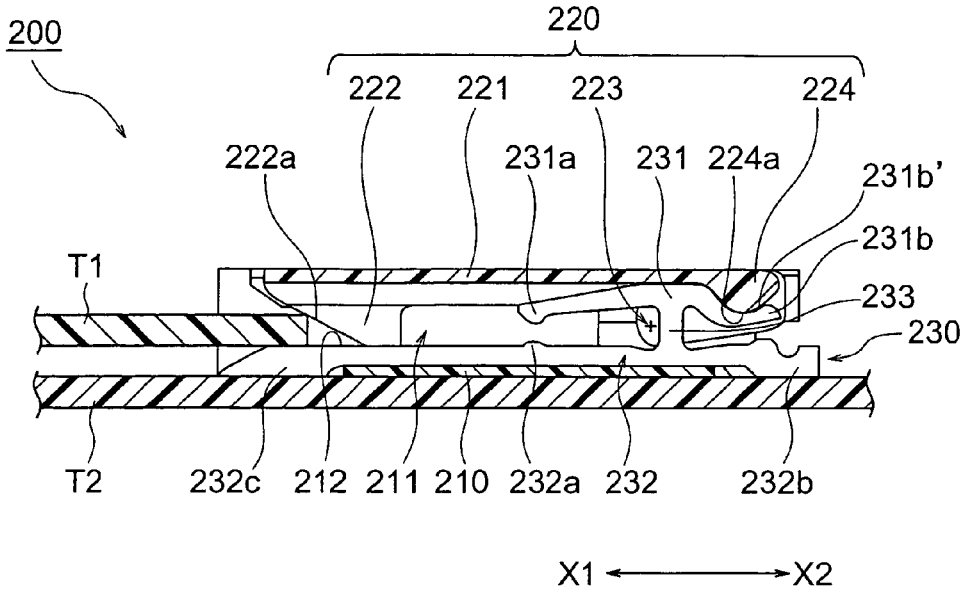
FIG. 8 is a sectional view of the second embodiment of the connector.
Figure 9:
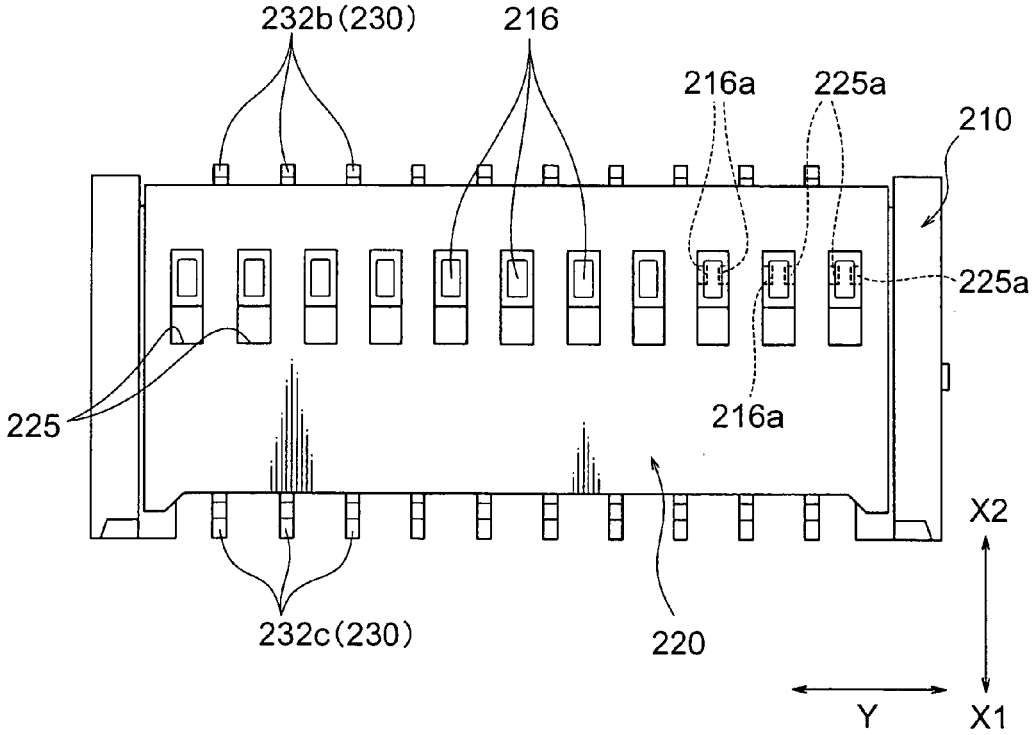
FIG. 9 is a top view of a connector according to the second embodiment of the present invention.

Referring to FIGS. 8 and 9, description will be given of a connector 200 according to a second embodiment of this invention. Structure of the second embodiment is identical to structure of the first embodiment except the contact 230, and hinge mechanism between the housing 210 and the actuator unit 220. Thereby description will be omitted about the structures except contact 230 and the hinge mechanism. Also, the same or similar components are assigned the reference numbers raised by 100 from the first embodiment.

Description will be given of only different point between the first embodiment and the second embodiment about the contact 230. Referring to FIG. 8, the second beam portion 232 of the contact 230 has a second terminal portion 232*c* in addition to the second clipping portion 232*a* and the terminal portion 232*b*. The second terminal portion 232*c* is located on the front side X1 of the second clipping portion 232*a* in the inserting direction X and which is mounted to the second base-plate T2 by solder.

Description will be given of only different points between the first embodiment and the second embodiment about the hinge mechanism between the housing 210 and the actuator unit 220. In the first embodiment of the connector 100, the hinge mechanism between the housing 110 and the actuator unit 120 comprises the pair of the rotary axis 123 of the body portion 121 and the pair of the bearing portion 114 of the housing 110, that is to say, the housing 110 and the actuator unit 120 are connected by hinge at both sides of the contact-width direction Y.

On the other hand, in the second embodiment of the connector 200 illustrated in FIGS. 8 and 9, the housing 210 and the actuator unit 220 are connected by hinge at a number of places in the contact-width direction Y, as mentioned below.

That is to say, in FIG. 9, the housing 210 has a number of projecting walls 216 which are located in parallel with predetermined interval in the contact-width direction Y and which is projected toward actuator unit 220. Depressed second bearing portions 216*a* are formed on both sides of a number of the projecting walls 216 in the contact-width direction Y respectively.

The actuator unit 220 has a number of slit portions 225 at corresponding places of a number of the projecting walls 216 of the housing 210. Referring to FIG. 9, pin portions 225*a* are formed on both sides of the slit portions 225 in the contact-width direction Y, and the pin portions 225*a* are projected toward the contact-width direction Y. Central axes of the pin portions 225*a* correspond to the rotary axis 223. The second bearing portions 216*a* rotatably bear the pin portions 225*a*. In FIG. 8, the operating point portion 224 is located on the back side X2 of the clipping portions 231*a*, 232*a* in the inserting direction X.

In the case of this embodiment of the connector 200, the connector 200 has a number of the pin portions 225*a* and a number of the second bearing portions 216*a* over the contact-width direction Y. Therefore, it is possible to reduce severity of force which impinges on each coupling portion and to prevent the actuator unit 220 from being damaged.

Figure 10:
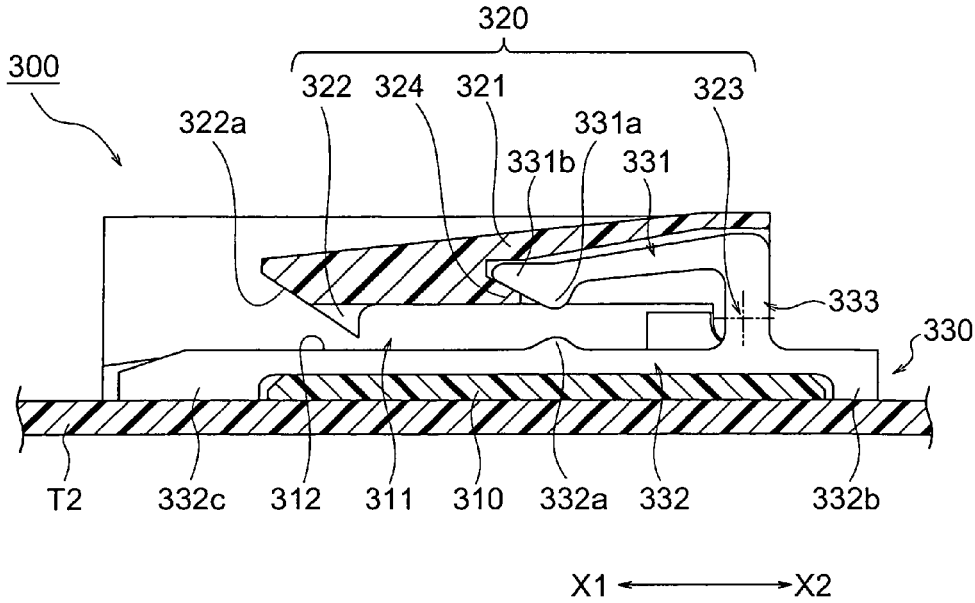
FIG. 10 is a sectional view of a connector according to a reference example of the present invention before attaching the first base-plate to the connector.
Figure 11:
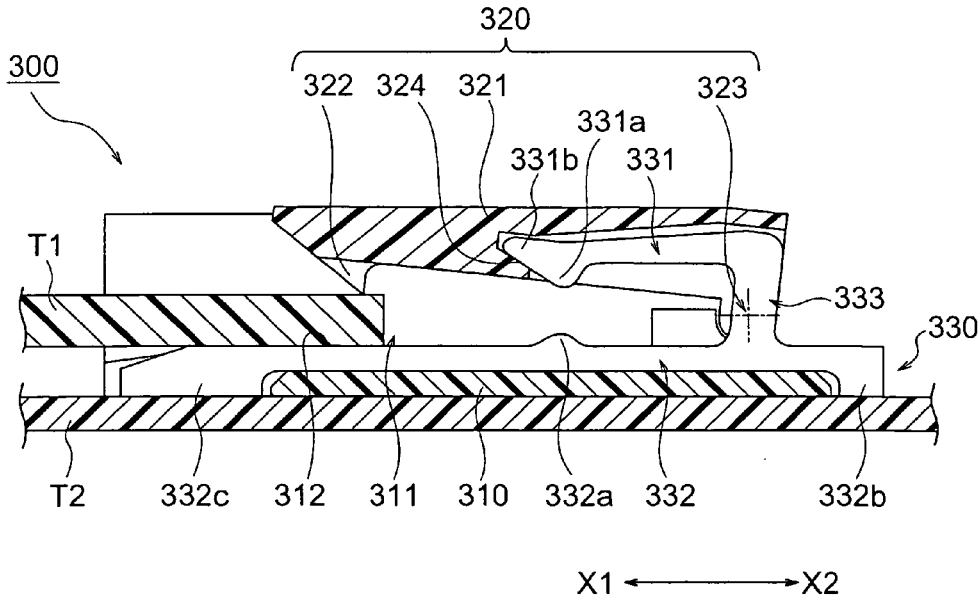
FIG. 11 is a sectional view of the connector according to the reference example before attaching the first base-plate to the connector.

Referring to FIGS. 10 and 11, description will be given of a connector 300 according to a reference example of this invention. Structure of the reference example is identical to that of the first embodiment except the contact 330 and the actuator unit 320. Therefore, description will be omitted of the structures except the contact 330 and the actuator unit 320. Also the same or similar components are assigned the reference numbers raised by 200 from the first embodiment.

It is to be noted in FIGS. 10 and 11 that a location of the operating point portion 324 is different from the first embodiment. That is to say, in FIGS. 10 and 11, the operating point portion 324 of the actuator unit 320 is formed in a hook shape on the front side X1 of the axis 323 and the back side X2 of the action point portion 322 in the inserting direction X. The operating point portion 324 pushes up the operated portion 331*b* of the contact 330 so that the operated portion 331*b* moves away from the base-plate installation face 312 during inserting the first base-plate T1.

In addition, a location of the first beam portion 331 and a location of the operated portion 331*b* of the first beam portion 331 are also different from the first embodiment. That is to say, referring to FIGS. 10 and 11, the first beam portion 331 of the contact 330 is connected to the coupling portion 333 at an end on the back side X2 of the inserting direction X of the first beam portion 331. Moreover, the operated portion 331*b* of the contact 330 is located on the front side X1 of the first clipping portion 331*a* in the inserting direction X.

Further referring to FIGS. 10 and 11, the second beam portion 332 of the contact 330 has a second terminal portion 332*c* in addition to the second clipping portion 332*a* and the terminal portion 332*b*. The second terminal portion 332*c* is located on the front side X1 of the second clipping portion 332*a* in the inserting direction X and is solder-mounted to the second base-plate T2.

Figure 12:
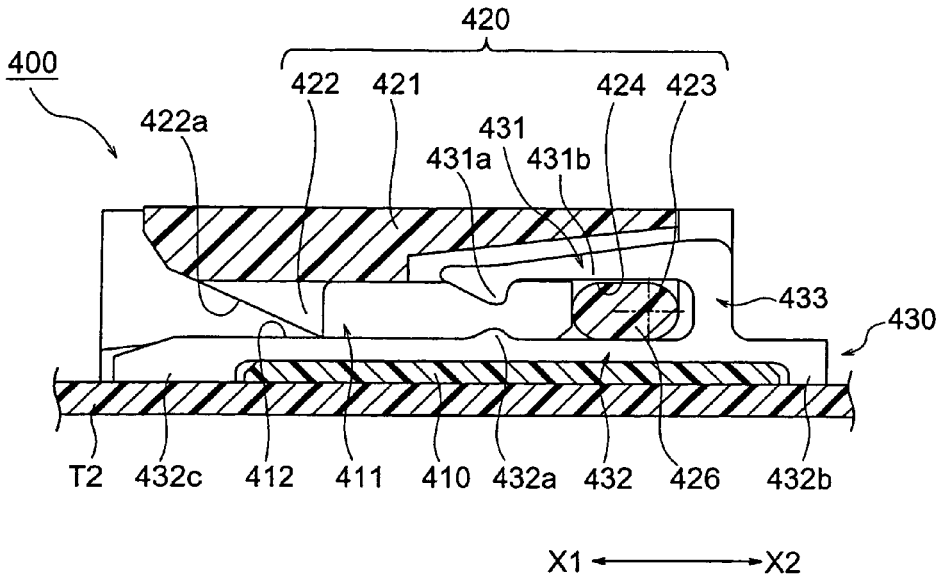
FIG. 12 is a sectional view of a connector according to the third embodiment of the present invention before attaching the first base-plate to the connector.
Figure 13:
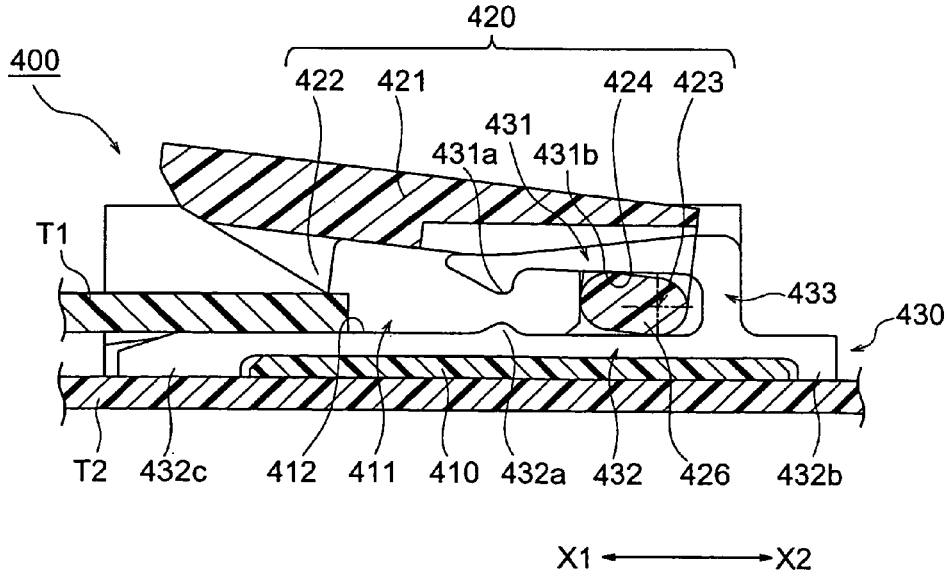
FIG. 13 is a sectional view of the connector according to the third embodiment during attaching the first base-plate to the connector.
Figure 14:
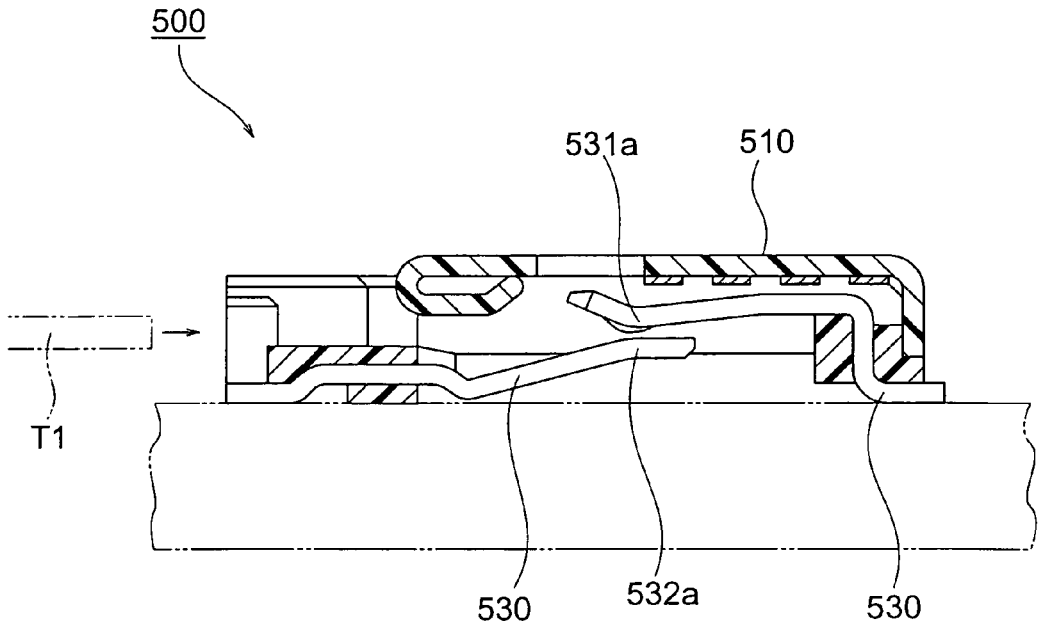
FIG.14 RELATED ART
FIG. 14 is a sectional view of a connector concerned with a related art.
Figure 15:
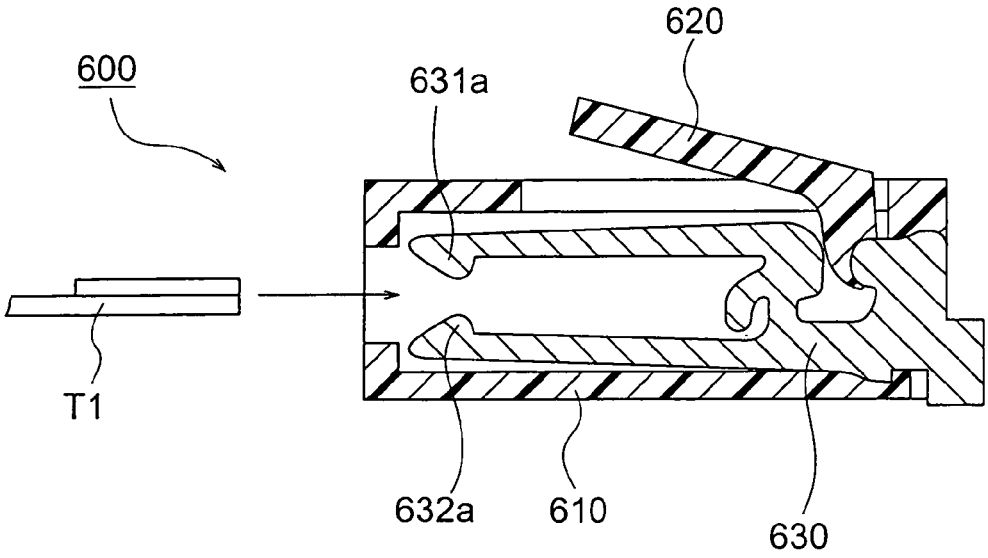
FIG. 15 RELATED ART
FIG. 15 is a sectional view of another connector device for flexible printed circuit, concerned with a related art.
Figure 16:
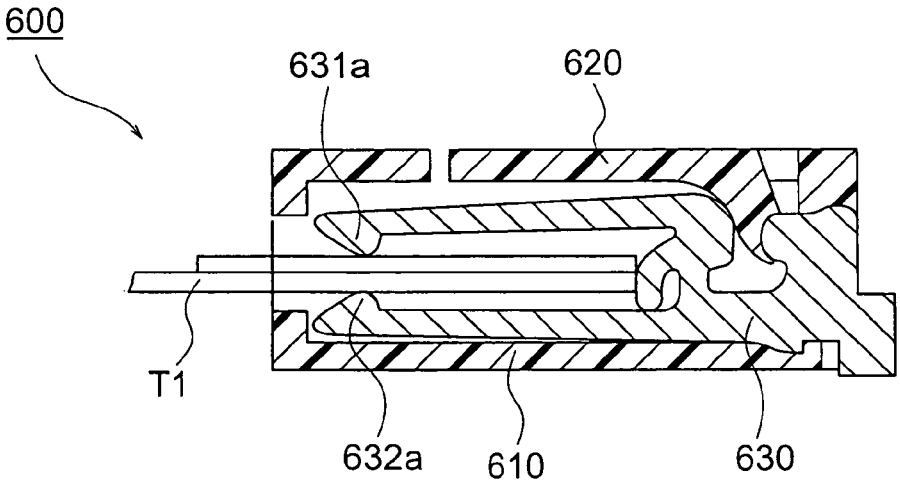
FIG. 16 RELATED ART
FIG. 16 is a sectional view of the connector device in FIG. 15 after a flexible printed wiring board is attached to the connector device.

Referring to FIGS. 12 and 13, description will be given of a connector 400 according to a third embodiment of this invention. Structure of the third embodiment is identical to that of the first embodiment except that a contact 430 and an actuator unit 420 are different in structure from those mentioned in conjunction with the first embodiment. Thereby description will be omitted of the structures except the contact 430 and the actuator unit 420. Also the same or similar components are assigned the reference numbers raised by 300 from the first embodiment.

A location of the operating point portion 424 is different from the first embodiment. That is to say, referring to FIGS. 12 and 13, the actuator unit 420 has a cam portion 426 which joints both sides of the body portion 421 in the contact-width direction Y and which is interposed between the first beam portion 431 and the second beam portion 432 on the front side X1 of the coupling portion 433 in the inserting direction X. As shown in FIGS. 12 and 13, the cam portion 426 has an approximately ellipsoidal shape in cross section. In FIG. 12, a length of the cam portion 426 in the inserting direction X is longer than length of the cam portion 426 in a direction perpendicular to the inserting direction X in the state illustrated in FIG. 12. A side face of the cam portion 426 facing to the first beam portion 431 functions as the operating point portion 424 which pushes up the operated portion 431*b* of the contact 430 so that the operated portion 431*b* moves away from the base-plate installation face 412 when the actuator unit 420 rotates. In FIG. 12, the operating point portion 424 is located on the back side X2 of the clipping portions 431*a*, 432*a* in the inserting direction X.

A location of the first beam portion 431 and a location of the operated portion 431*b* of the first beam portion 431 are also different from the first embodiment. Specifically, in FIGS. 12 and 13, the first beam portion 431 of the contact 430 is connected to the coupling portion 433 at an end on the back side X2 of the inserting direction X of the first beam portion 431. Moreover, the operated portion 431*b* of the contact 430 is located on the back side X2 of the first clipping portion 431*a* in the inserting direction X.

Referring to FIGS. 12 and 13, the second beam portion 432 of the contact 430 has a second terminal portion 432*c* in addition to the second clipping portion 432*a* and the terminal portion 432*b*. The second terminal portion 432*c* is located on the front side X1 of the second clipping portion 432*a* in the inserting direction X and which is solder-mounted to the second base-plate T2.

The first base-plate is explained as FPC (Flexible Printed Circuit) in the above-mentioned embodiment. However, the first base-plate may be anything which is formed as a flat connection object, and may be, for example, FFC (Flexible Flat Cable).

The actuator unit and the housing are individually formed and the actuator unit is rotatably mounted to the housing in the above-mentioned embodiment. However, the actuator unit and the housing may be integrally formed in order to reduce components in number. In this case, the housing and the actuator unit are formed of flexible materials, for example, nylon resin.

The first clipping portion of the contact functions as a contact point between the contact and the first base-plate in the above-mentioned embodiment. However, a contact point between the contact and the first base-plate may be formed on the first beam portion aside from the first clipping portion. The second clipping portion may function as the contact point between the contact and the first base-plate. A contact point between the contact and the first base-plate may be formed on the second beam portion aside from the second clipping portion. Both the first clipping portion and the second clipping portion may function as the contact point between the contact and the base-plate.

What is claimed is:

1. A connector for use in accepting a base-plate, the connector comprising;

a housing;

an actuator unit which is rotatably attached to the housing; and a contact which has a first clipping portion and a second clipping portion, wherein the actuator unit has:

a rotary axis which is located in a direction transverse to an inserting direction of the base-plate;

an action point portion which is rotatable around the rotary axis; and an operating point portion which is rotatable around the rotary axis, wherein at least one of the first clipping portion and the second clipping portion functions as the contact point between the contact and the base-plate, wherein the operating point portion is located on a back side of the clipping portions in the inserting direction of the base-plate, wherein the action point portion is pushed by the base-plate when the base-plate is inserted to the connector, wherein the actuator unit is rotated when the action point portion is pushed by the base-plate, wherein the operating point portion operates on the contact when the actuator unit is rotated.

2. The connector according to claim 1, wherein the contact comprises;

a first beam portion which is located near the actuator unit and which has the first clipping portion;

a second beam portion which is located near the housing and which has the second clipping portion; and a coupling portion which is located between the first beam portion and the second beam portion and which couples the first beam portion and the second beam portion, wherein the first beam portion has an operated portion which is located on the back side of the coupling portion in the inserting direction of the base-plate.

3. The connector according to claim 2, wherein the operating point portion has a convex curved surface which touches the operated portion of the contact when the actuator unit is rotated.

4. The connector according to claim 2, wherein the second beam portion has a terminal portion which is located on a front side of the second clipping portion in the inserting direction of the base-plate.

5. The connector according to claim 3, wherein the second beam portion has a terminal portion which is located on a front side of the second clipping portion in the inserting direction of the base-plate.

6. The connector according to claim 1, wherein the contact comprises a first beam portion which has the first clipping portion, and a second beam portion which faces to the first clipping portion and which has the second clipping portion, wherein the actuator unit has a cam portion which is interposed between the first beam portion and the second beam portion and which has the operating point portion.

7. The connector according to claim 1, wherein the actuator unit has a body portion, while the action point portion is projected from the body portion toward the housing and the action point portion is accommodated within an action point receiving portion which is formed on the housing.

* * * * *